US009890518B2

(12) United States Patent
Sato et al.

(10) Patent No.: US 9,890,518 B2
(45) Date of Patent: Feb. 13, 2018

(54) HYDRAULIC DRIVE SYSTEM FOR CONSTRUCTION MACHINE

(71) Applicant: HITACHI CONSTRUCTION MACHINERY CO., LTD., Tokyo (JP)

(72) Inventors: Kensuke Sato, Ushiku (JP); Tsuyoshi Nakamura, Tsuchiura (JP); Kouji Ishikawa, Kasumigaura (JP)

(73) Assignee: HITACHI CONSTRUCTION MAHINERY CO., LTD., Tokyo (JP)

( * ) Notice: Subject to any disclaimer, the term of this patent is extended or adjusted under 35 U.S.C. 154(b) by 359 days.

(21) Appl. No.: 14/431,062

(22) PCT Filed: Oct. 15, 2013

(86) PCT No.: PCT/JP2013/077995
§ 371 (c)(1),
(2) Date: Mar. 25, 2015

(87) PCT Pub. No.: WO2014/073338
PCT Pub. Date: May 15, 2014

(65) Prior Publication Data

US 2015/0252554 A1 Sep. 10, 2015

(30) Foreign Application Priority Data

Nov. 7, 2012 (JP) ..... 2012-245728

(51) Int. Cl.
*E02F 9/22* (2006.01)
*F15B 21/14* (2006.01)
(Continued)

(52) U.S. Cl.
CPC ..... *E02F 9/2217* (2013.01); *E02F 9/2075* (2013.01); *E02F 9/2095* (2013.01);
(Continued)

(58) Field of Classification Search
CPC ..... E02F 9/2217; E02F 9/2095; F15B 11/024; F15B 21/14; F15B 2211/3058; F15B 2211/88
See application file for complete search history.

(56) References Cited

U.S. PATENT DOCUMENTS 7,827,787 B2 * 11/2010 Cherney ..... E02F 9/2203 60/414
9,260,835 B2 * 2/2016 Kang, II ..... E02F 3/435
(Continued)

FOREIGN PATENT DOCUMENTS

EP 2 518 218 A2 10/2012
JP 4279838 B2 3/2009
(Continued)

OTHER PUBLICATIONS

Machine translation of JP2009299719A. 2009.*
(Continued)

*Primary Examiner* — Thomas E Lazo
*Assistant Examiner* — Michael Quandt
(74) *Attorney, Agent, or Firm* — Mattingly & Malur, PC

(57) ABSTRACT

During boom-midair lowering operation in which a front work implement 130 can be turned under the self-weight of a boom 131, a hydraulic pump/motor 7 is operated as a motor to operate a generator/electric motor 10 as a generator. Power generation operation is performed by the hydraulic fluid discharged from a bottom-side chamber 5*b* of a boom cylinder 5 to recover positional energy. During jack-up in which the front work implement 130 cannot be turned under the self-weight of the boom 131, the generator/electric motor 10 is operated as an electric motor to operate the hydraulic pump/motor 7 as a pump. The jack-up is performed by supplying the hydraulic fluid from the bottom-side chamber 5*b* to rod-side chamber 5*a* of the boom cylinder 5 without supplying the hydraulic fluid from the
(Continued)

main pump 2 to the rod-side chamber 5*a* of the boom cylinder 5.

4 Claims, 10 Drawing Sheets

(51) Int. Cl.
*E02F 9/20* (2006.01)
*F15B 11/024* (2006.01)

(52) U.S. Cl.
CPC ..... *E02F 9/2221* (2013.01); *E02F 9/2282* (2013.01); *E02F 9/2285* (2013.01); *E02F 9/2296* (2013.01); *F15B 11/024* (2013.01); *F15B 21/14* (2013.01); *F15B 2011/0246* (2013.01); *F15B 2211/20569* (2013.01); *F15B 2211/3058* (2013.01); *F15B 2211/40515* (2013.01); *F15B 2211/41527* (2013.01); *F15B 2211/41563* (2013.01); *F15B 2211/6313* (2013.01); *F15B 2211/6316* (2013.01); *F15B 2211/88* (2013.01)

(56) References Cited

U.S. PATENT DOCUMENTS 9,512,596 B2 * 12/2016 Kang, Il ..... E02F 9/2075
2012/0180470 A1 7/2012 Schroeder et al.

FOREIGN PATENT DOCUMENTS

| | | | |
|---|---|---|---|
| JP | 4279837 | B2 | 6/2009 |
| JP | 2009-299719 | A | 12/2009 |
| JP | 2010-112559 | A | 5/2010 |
| WO | 2004/070211 | A1 | 8/2004 |

OTHER PUBLICATIONS

Extended European Search Report received in corresponding European Application No. 13852377.4 dated Jun. 20, 2016.

International Preliminary Report on Patentability received in corresponding International Application No. PCT/JP2013/077995 dated May 21, 2015.

* cited by examiner

HYDRAULIC DRIVE SYSTEM FOR CONSTRUCTION MACHINE

TECHNICAL FIELD

The present invention relates to a hydraulic drive system provided for a construction machine such as an excavator or the like, and in particular to a hydraulic drive system for a construction machine that recovers positional energy of a front work implement when the front work implement is lowered.

BACKGROUND ART

Patent Document 1 describes a hydraulic drive system as below. A first holding valve is provided in an actuator line between the bottom-side chamber of a boom cylinder and a directional control valve (a changeover valve). A recovery pump motor is disposed via a second holding valve in a line branching from the actuator line. The recovery pump motor is connected on the discharge side thereof to a tank via a proportional restrictor. This hydraulic drive system is such that during the boom-lowering operation in midair in which the boom cylinder can be contracted under the self-weight of a front work implement, the recovery pump motor is rotated by opening the second holding valve to discharge the hydraulic fluid from the bottom-side chamber of the boom cylinder. The rotation of the recovery pump rotates a generator to recover the positional energy of the front work implement. If the front work implement is brought into contact with the ground for excavating, a directional control valve is switched so as to supply hydraulic fluid from a hydraulic pump to the rod-side chamber of the boom cylinder. In addition, the first and second holding valves are opened to discharge the hydraulic fluid in the bottom-side chamber of the boom cylinder for ensuring a necessary excavating force.

Patent Document 2 describes a hydraulic drive system that includes a jack-up changeover valve and a flow control valve. The jack-up changeover valve is switched when the pressure in the bottom-side chamber of a boom cylinder becomes equal to or higher than a predetermined pressure. With the switching operation of this changeover valve the flow control valve opens or closes a line adapted to supply hydraulic fluid from a main pump to the rod-side chamber of the boom cylinder. The hydraulic drive system is such that during the boom-lowering operation in midair in which the boom cylinder can be contracted under the self-weight of a front work implement, the jack-up changeover valve is switched to close the flow control valve. The supply of the hydraulic fluid from the main pump to the rod-side chamber of the boom cylinder is blocked. In addition, the hydraulic fluid discharged from the bottom-side chamber of the boom cylinder is supplied to the rod-side chamber for recovery. Thus, pump-consumption horsepower is controlled during the boom-midair lowering operation. During the jack-up in which the boom cannot be lowered under self-weight, the jack-up changeover valve is not switched because of the low pressure in the bottom-side chamber of the boom cylinder. The flow control valve is held at an open position and hydraulic fluid is supplied from the main pump to the rod-side chamber of the boom cylinder. Thus, the jack-up operation is enabled.

PRIOR ART DOCUMENTS

Patent Documents

Patent Document 1: JP-2009-299719-A
Patent Document 2: WO2004-070211

SUMMARY OF THE INVENTION

Problem to be Solved by the Invention

The hydraulic drive system described in Patent Document 1 is such that during the boom-midair lowering operation in which the boom cylinder is contracted under the self-weight of the front work implement, the positional energy of the front work implement is recovered as electric energy for improving energy efficiency. It is conceivable that the jack-up operation can also be performed, similarly to the case of performing the excavating, by switching the directional control valve to supply hydraulic fluid from the main pump to the rod-side chamber of the boom cylinder and by opening the first and second holding valves to discharge the hydraulic fluid in the bottom-side chamber of the boom cylinder. To that end, however, it is necessary to install the first and second holding valves and to control the opening and closing thereof. The circuit configuration of the hydraulic drive system becomes complicated. As a result, difficulties may probably occur in terms of installation space and costs. During the jack-up operation, it is necessary to supply hydraulic fluid from the main pump to the rod-side chamber of the boom cylinder; therefore, there is room for improvement in view of energy efficiency.

The hydraulic drive system described in Patent Document 2 is such that during the boom-midair lowering operation in which the boom cylinder is contracted under the self-weight of the front work implement, the recovery of the hydraulic fluid is achieved by supplying the hydraulic fluid in the bottom-side chamber of the boom cylinder to the rod-side chamber. However, the positional energy of the front work implement cannot be recovered as electric energy. The jack-up operation can be performed by using the pressure in the bottom-side chamber of the boom cylinder to switch the jack-up changeover valve and the flow control valve and supplying the hydraulic fluid from the main pump to the bottom-side chamber of the boom cylinder. It is necessary, however, to install the jack-up changeover valve and the flow control valve in order to allow for both the boom-midair lowering operation and the jack-up operation. The circuit configuration of the hydraulic drive system becomes complicated. Thus, difficulties probably occurs in terms of installation space and costs. Also in this conventional technology, the jack-up operation needs to supply the hydraulic fluid from the hydraulic pump to the rod-side chamber of the boom cylinder. Thus, there is room for improvement in view of energy efficiency.

It is an object of the present invention to provide a hydraulic drive system for a construction machine that can allow for both boom-midair lowering operation and jack-up operation and that can improve energy efficiency more than ever.

Means for Solving the Problem

To achieve the above object, a first invention is a hydraulic drive system for driving a working element in a construction machine, including: a main pump; a double-acting hydraulic cylinder driven by hydraulic fluid discharged from the main pump for driving the working element, the hydraulic cylinder having a rod-side chamber and a bottom-side chamber, the working element having a self-weight acting in a direction in which the hydraulic cylinder contracts; an operating device; a directional control valve adapted, when the operating device is operated for the working element to work in a rising direction, to supply hydraulic fluid discharged from the main pump to the bottom-side chamber of the hydraulic cylinder and to return the hydraulic fluid discharged from the rod-side chamber of the hydraulic cylinder to a tank; a discharge line connecting the bottom-side chamber of the hydraulic cylinder to the tank; a hydraulic pump/motor disposed in the discharge line; a first variable restrictor disposed in a portion of the discharge line between the hydraulic pump/motor and the tank; a recovery circuit for connecting a portion of the discharge line between the hydraulic pump/motor and the variable restrictor to the rod-side chamber of the boom cylinder; a generator/electric motor connected to the hydraulic pump/motor for integral rotation therewith; and a control unit configured to control the generator/electric motor as a generator and to control an opening area of the first variable restrictor such that a certain recovery flow rate is supplied from the recovery circuit to the rod-side chamber of the hydraulic cylinder when the operating device is operated for the working element to work in the descending direction and the hydraulic cylinder is descendable under the self-weight of the working element, the control unit further configured to control the generator/electric motor as an electric motor and to control the opening area of the first variable restrictor such that the certain recovery flow rate is supplied from the recovery circuit to the rod-side chamber of the hydraulic cylinder when the operating device is operated for the working element to work in the descending direction and the hydraulic cylinder is not descendable under the self-weight of the working element.

With this characteristic, if the operating device is operated for the working element to work in a descending direction and the working element can be turned under the self-weight thereof, the generator/electric motor is operated as a generator to recover the positional energy. The hydraulic fluid after the recovery is partially supplied to the rod-side chamber of the hydraulic cylinder via the recovery circuit. Thus, energy efficiency can be improved without supplying the hydraulic fluid to the rod-side chamber of the hydraulic cylinder from the main pump. If the working element cannot be turned under the self-weigh thereof, the generator/electric motor is operated as an electric motor to operate the hydraulic pump/motor as a pump. The hydraulic fluid is supplied from the bottom-side chamber to rod-side chamber of the hydraulic cylinder. Therefore, the jack-up is enabled without supplying the hydraulic fluid to the rod-side chamber of the hydraulic cylinder from the main pump. Thus, the hydraulic drive system for the construction machine has a simplified circuit configuration, probably causes no difficulty in terms of installation space and costs, has no need to supply the hydraulic fluid from the main pump during the jack-up operation, and achieves an improvement in energy efficiency.

In the first invention, a second invention further includes a pressure detecting device for detecting pressure in the bottom-side chamber of the hydraulic cylinder. When the operating device is operated for the working element to work in the descending direction, with the pressure detected by the pressure detecting device being equal to or higher than a predetermined pressure, the control unit determines that the hydraulic cylinder is descendable under the self-weight of the working element, whereas if not, the control unit determines that the hydraulic cylinder is not descendable under the self-weight of the working element.

This can achieve, with the simple configuration, a determination as to whether or not the working element can be turned under the self-weight thereof.

In the first invention, a third invention further includes: a first line for connecting the directional control valve to the bottom-side chamber of the hydraulic cylinder; a second line for connecting the directional control valve to the rod-side chamber of the hydraulic cylinder; and a second variable restrictor disposed in the first line. The directional control valve is configured such that, when the operating device is operated for the working element to work in the rising direction, the main pump becomes connected to the first line and the second line becomes connected to the tank, and when the operating device is operated for the working element to work in the descending direction, the first line becomes connected to the tank and the second line becomes blocked. The control unit controls the second variable restrictor such that, when the operating device is operated for the working element to work in the rising direction, the second variable restrictor becomes an open state, and when the operating device is operated for the working element to work in the descending direction, the second variable restrictor switches into a closed state, the switching speed into a closed state decreasing as the operation speed of the operation device increases.

This can increase the response speed of the hydraulic cylinder in response to the operation of the operation device encountered when the hydraulic cylinder is operated, particularly, when operated in the lowering direction. Thus, an improvement in operability can be achieved.

In the first invention, a fourth invention is such that when the operating device is operated in the direction in which the working element lowers, with the hydraulic cylinder not being descendable under the self-weight of the working element, the control unit controls the rotation speed of the generator/electric motor for controlling a delivery rate of the hydraulic pump/motor.

This can achieve the lowering-directional operation speed of the working element in accordance with the operation amount and operation speed of the operation device with the configuration to recover the positional energy of the working element.

In the first invention, a fifth invention is such that when the operating device is operated in the direction in which the working element lowers, with the hydraulic cylinder not being descendable under the self-weight of the working element, the control unit controls the capacity of the hydraulic pump/motor for controlling the delivery rate of the hydraulic pump/motor.

This can achieve the lowering-directional operation speed of the working element in accordance with the operation amount and operation speed of the operation device with a simple configuration.

Effects of the Invention

The present invention can, with a simple configuration, perform both the boom-midair lowering operation and the jack-up operation and improve energy efficiency more than ever.

MODE FOR CARRYING OUT THE INVENTION

Embodiments of a hydraulic drive system for a construction machine of the present invention will hereinafter be described with reference to the drawings.

<Construction Machine>

A construction machine provided with a hydraulic drive system according to the present invention will first be described with reference to FIG. 2.

Figure 2:
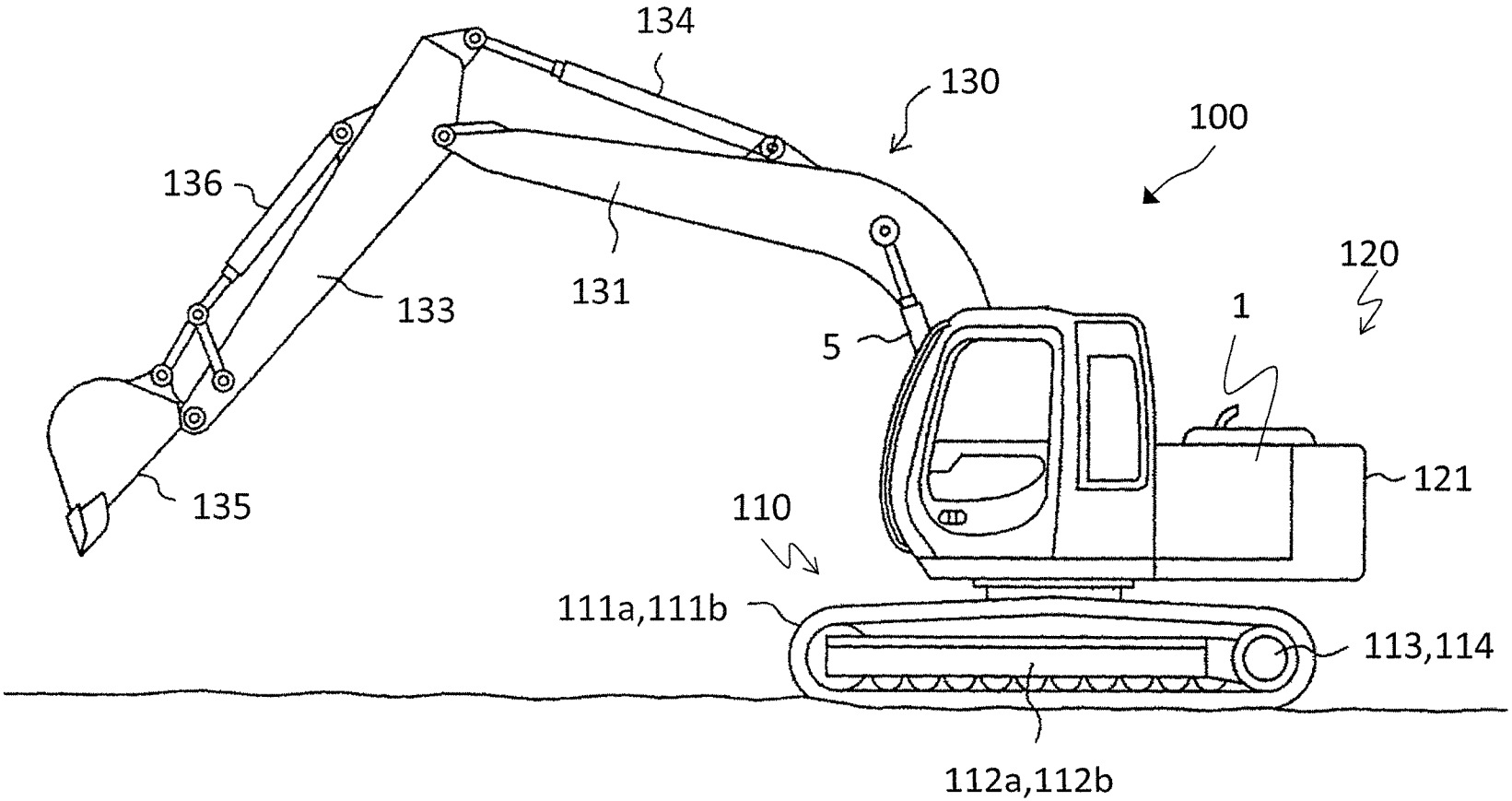
FIG. 2 is a lateral view of a hydraulic excavator having a first embodiment of the hydraulic drive system for the construction machine of the present invention.

FIG. 2 illustrates a hydraulic excavator, which is one example of construction machines, provided with a hydraulic drive system according to the present invention.

Referring to FIG. 2, a hydraulic excavator 100 includes a track structure 110, a swing structure 120 provided for swing on the track structure 110, and a front work implement 130 supported for vertical turning on the swing structure 120.

The track structure 110 is composed of a pair of crawlers 111*a*, 111*b* (only one side is shown in FIG. 2), a pair of crawler frames 112*a*, 112*b* (only one side is shown in FIG. 2), a pair of right and left traveling hydraulic motors 113, 114 (only one side is shown in FIG. 2) which controllably drive the associated crawlers 111*a*, 111*b*, reduction gears therefor and the like.

The front work implement 130 includes a boom 131 supported for turning on the swing structure 120, a boom cylinder 5 for driving the boom 131, an arm 133 supported for turning in the vicinity of a leading end portion of the boom 131, an arm cylinder 134 for driving the arm 133, a bucket 135 supported for turning at an end of the arm 133, and a bucket cylinder 136 for driving the bucket 135.

First Embodiment

A first embodiment of a hydraulic drive system for the construction machine of the present invention is described with reference to FIGS. 1 to 5.

Figure 1:
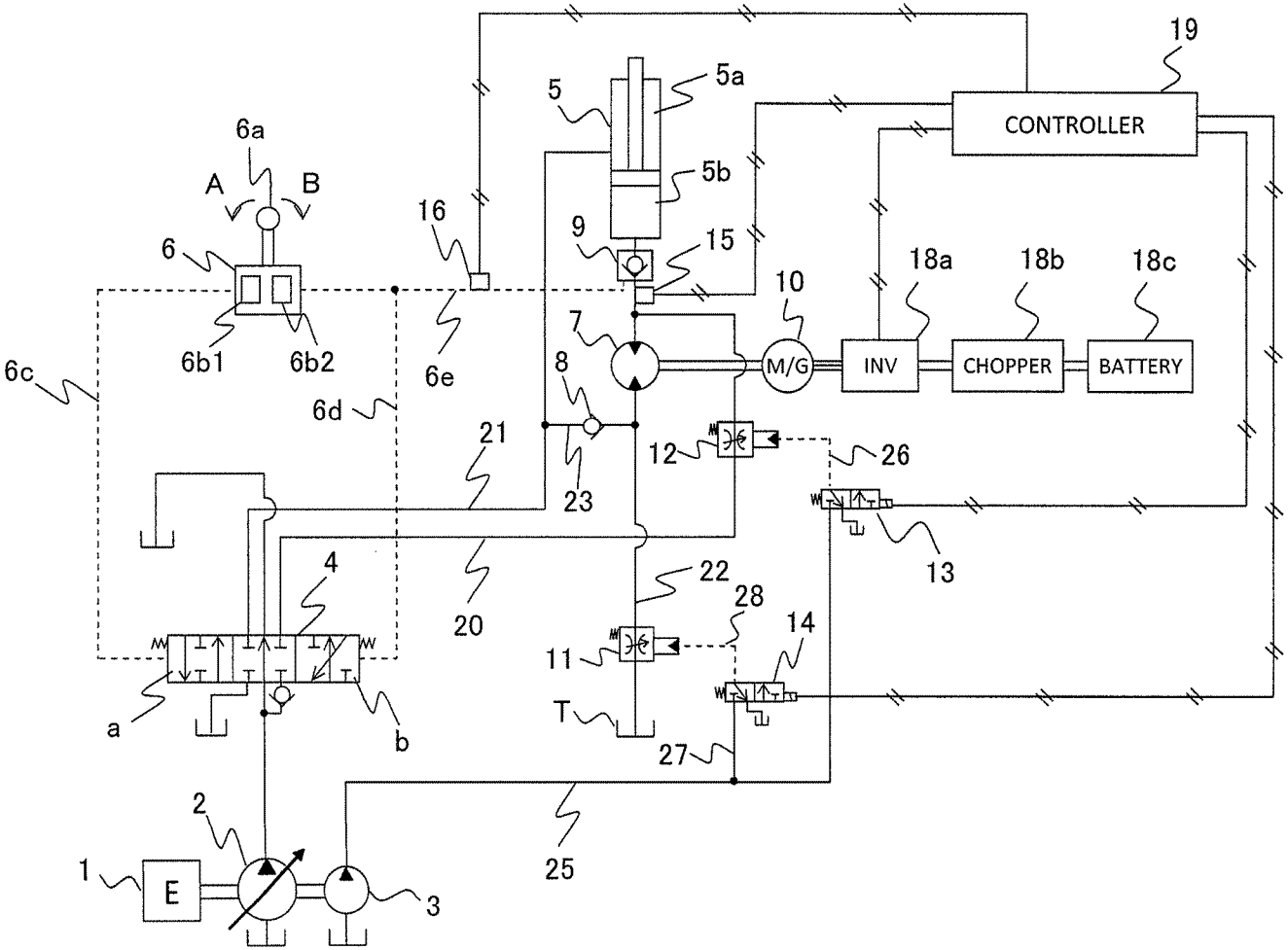
FIG. 1 is a configuration diagram showing an outline of a first embodiment of a hydraulic drive system for a construction machine of the present invention.

FIG. 1 shows the first embodiment of the hydraulic drive system for the construction machine of the present invention and an outline of the hydraulic drive system for the boom cylinder 5 which drives the boom 131 in the front work implement 130 mounted in the hydraulic excavator 100.

Referring to FIG. 1, the hydraulic drive system for the construction machine includes a main pump 2, a pilot pump 3, and the boom cylinder 5 driven by hydraulic fluid discharged by the main pump 2. The main pump 2 and the pilot pump 3 are rotatably driven by an engine 1 to discharge hydraulic operating fluid.

The boom cylinder 5 is a double acting type single rod cylinder. The boom cylinder 5 has a rod-side chamber 5*a* and a bottom-side chamber 5*b*. The boom cylinder 5 is mounted to the boom 131 so that the boom 131 may be turned in a rising direction when the boom cylinder 5 is extended and the boom 131 may be turned in a lowering direction when the boom cylinder 5 is contracted. The self-weight of the boom 131 of the front work implement 130 acts in the contracting direction of the boom cylinder 5.

The hydraulic drive system includes a directional control valve 4, a first line 20, a second line 21 and a discharge line 22. The directional control valve 4 controls the flow (a direction and a flow rate) of the hydraulic fluid supplied from the main pump 2 to the boom cylinder 5. The first line 20 connects the directional control valve 4 to the bottom-side chamber 5*b* of the boom cylinder 5. The second line 21 connects the directional control valve 4 to the rod-side chamber 5*a* of the boom cylinder 5. The discharge line 22 connects the bottom-side chamber 5*b* of the boom cylinder 5 to a tank T.

When assuming a neutral position, the directional control valve 4 blocks the first line and the second line to return the hydraulic fluid discharged from the main pump 2 to the tank T. When a control lever device 6 is operated to move the boom 131 in the rising direction, the main pump 2 is connected to the first line 20 to supply the hydraulic fluid discharged from the main pump 2 to the bottom-side chamber 5*b* of the boom cylinder 5. In addition, the second line 21 is connected to the tank T to return the hydraulic fluid discharged from the rod-side chamber 5*a* of the boom cylinder 5 to the tank T. When the control lever device 6 is operated in the lowering direction of the boom cylinder 5, the directional control valve 4 returns the hydraulic fluid discharged from the main pump 2 to the tank T directly. In addition, the directional control valve 4 connects the first hydraulic line 20 to the tank T and blocks the second line 21.

A variable restrictor 12, the degree of restriction (the opening area) of which is variable, is located in the first line 20. The opening area of the variable restrictor 12 is controlled by an electromagnetic valve 13. The electromagnetic valve 13 is controlled in the opening area thereof in response to a control signal (a target current value I) from a controller 19.

A holding valve 9 and a pressure sensor (a pressure detecting device) 15 are located in the first line 20 at a portion close to the bottom-side chamber 5*b* of the boom cylinder 5. The holding valve 9 is a pilot check valve, which is opened when the control lever device 6 is operated so that the front work implement 130 may be operated in the lowering direction. The pressure sensor 15 detects the pressure in the bottom-side chamber 5*b* of the boom cylinder 5 and outputs the pressure thus detected to the controller 19.

A hydraulic pump/motor 7 is located in the discharge line 22 at a portion between the holding valve 9 and the tank T. A generator/electric motor 10 is connected to the hydraulic pump/motor 7 so as to be rotated integrally with the hydraulic pump/motor 7. The hydraulic pump/motor 7 functions as a hydraulic motor that is rotated by the hydraulic fluid which flows out from the bottom-side chamber 5*b* of the boom cylinder 5 when the boom 131 lowers under the self-weight thereof. In this way, the rotating shaft of the generator/electric motor 10 is rotated to allow the generator/electric motor 10 to function as a generator. The hydraulic pump/motor 7 functions as a hydraulic pump that is rotated by the rotation of the generator/electric motor 10 which functions as an electric motor during jack-up or the like. In this way, the hydraulic fluid in the bottom-side chamber 5*b* of the boom cylinder 5 is partially supplied to the rod-side chamber 5*a* of the boom cylinder 5 via a recovery circuit 23 (described later) and the second line 21.

The generator/electric motor 10 generates electric energy, which is stored in a battery 18*c* via an inverter 18*a* and a chopper 18*b*. In addition, the generator/electric motor 10 is rotated using the electric energy thus stored in the battery 18*c*. The generator/electric motor 10 is controlled in power generation torque and rotation speed, for its functioning as a generator or an electric motor, in response to control current outputted by the controller 19 so that the lowering speed of the boom 131 may become a lowering speed corresponding to the operation amount of a control lever 6*a* of the control lever device 6.

A variable restrictor 11, the opening area of which is variable, is located in the discharge line 22 at a portion between the hydraulic pump/motor 7 and the tank T. The variable restrictor 11 is controlled in the opening area thereof by an electromagnetic valve 14. The electromagnetic valve 14 controls the opening area in response to a control signal (a target current value I) from the controller 19.

The recovery circuit 23 is disposed between the second line 21 and a portion of the discharge line 22 between the hydraulic pump/motor 7 and the variable restrictor 11 so as to connect such a portion of the discharge line 22 to the rod-side chamber 5*a* of the boom cylinder 5. The recovery circuit 23 has a check valve 8 adapted to permit the flow of hydraulic fluid only in a direction from the discharge line 22 toward the second line 21.

The control lever device (the operating device) 6 for controlling the moving direction of the boom cylinder 5 is installed in a cabin of the hydraulic excavator 100. The control lever device 6 has the control lever 6*a* and pilot valves (pressure-reducing valves) 6*b*1, 6*b*2. If the control lever 6*a* of the control lever device 6 is operated in a boom-raising direction A, the pilot valve 6*b*1 produces a pilot pressure according to the operation amount of the control lever 6*a* using the discharge pressure of the pilot pump 3 as an original pressure. In addition, the pilot valve 6*b*1 outputs the pilot pressure to a pilot line 6*c* to switch the directional control valve 4 to an "a" position. If the control valve 6*a* is operated in a boom-lowering direction B, the pilot valve 6*b*2 produces a pilot pressure according to the operation amount of the control lever 6*a* using the discharge pressure of the pilot pressure as an original pressure. In addition, the pilot valve 6*b*2 outputs the pilot pressure to a pilot line 6*d* to switch the directional control valve 4 to a "b" position and to open the holding valve 9 via a pilot line 6*e* branching from the pilot line 6*d*. A pressure sensor 16 for detecting the pressure (the pilot pressure) of the hydraulic fluid of the pilot line 6*e* is provided in the pilot line 6*e*. The pressure sensor 16 outputs the pressure signal detected thereby to the controller 19.

The controller 19 is a control unit. The controller 19 calculates the target currents I used to control the opening areas of the electromagnetic valves 13, 14 on the basis of the pressure detected by the pressure sensor 16 provided in the pilot line 6*d* and the pressure detected by the pressure sensor 15 provided in the discharge line 22. In addition, on the basis of the computing results, the controller 19 controls the electromagnetic valves 13, 14 to control the opening areas of the variable restrictors 11, 12. Further, on the basis of the pressures detected by the pressure sensors 15 and 16, the controller 19 calculates a torque instruction value used to control the rotation speed of the generator/electric motor 10 and outputs it to the inverter 18*a* to control the delivery rate of the hydraulic pump/motor 7.

—Operation—

A description is next given of the operation of the hydraulic driving system for the construction machine according to the first embodiment described with reference to FIGS. 3 to 5.

—Boom-Raising—

In the hydraulic excavator 100 as illustrated in FIG. 2, if an operator operates the control lever 6*a* of the control lever device 6 in the boom-raising direction A, the pilot valve 6*b*1 of the control lever device 6 outputs the pilot pressure according to the operation amount of the control lever 6*a* to the pilot line 6*c* to switch the directional control valve 4 to the "a" position. In this case, the variable restrictor 12 is controlled to be fully opened and the hydraulic fluid discharged from the main pump 2 passes through the first line 20 via the directional control valve 4 and flows into the bottom-side chamber 5*b* of the boom cylinder 5. As a result, the boom cylinder 5 is extended to turn the boom 131 in the rising-direction. The hydraulic fluid discharged from the rod-side chamber 5*a* of the boom cylinder 5 is returned to the hydraulic operating fluid tank T via the second line 21 and the directional control valve 4.

—Boom-Midair Lowering—

A description is next given of operation encountered when an operator operates the control lever 6*a* of the control lever device 6 in the boom-lowering direction B in a state where the front work implement 130 is in midair, that is, in a state where the front work implement 130 assumes such a posture as to be able to turn in the lowering direction under the self-weight of the boom 131.

If the operator operates the control lever 6*a* of the control lever device 6 in the boom-lowering direction B, the pilot valve 6*b*2 of the control lever device outputs the pilot pressure according to the operation amount of the control lever 6*a* to the pilot line 6*d*, thereby switches the directional control valve 4 to the "b" position. At the same time, the pilot pressure acts on the holding valve 9 via the pilot line 6*e* to open it, allowing hydraulic fluid to flow out from the bottom-side chamber 5*b* of the boom cylinder 5. In this case, because of gravitational force acting on the front work implement 130, the bottom-side chamber 5*b* of the boom cylinder 5 becomes high-pressure, which is detected by the pressure sensor 15. In addition, the pressure sensor 16 detects the pilot pressure acting on the holding valve 9.

The pilot pressure detected by the pressure sensor 16 may be higher than the minimum pressure of the pilot pressure and the pilot pressure detected by the pressure sensor 15 may be equal to or higher than a predetermined pressure. In such a case, the controller 19 determines that the front work implement 130 can be turned under the self-weight of the boom 131. In addition, the controller 19 exercises the control as below.

The controller 19 first exercises such control as to reduce the opening area of the variable restrictor 12 so that the hydraulic fluid discharged from the bottom-side chamber 5*b* of the boom cylinder 5 may not flow in the first line 20 but flow in the discharge line 22. FIG. 3 shows control-content (calculation) processing performed by the controller 19 at this time.

Figure 3:
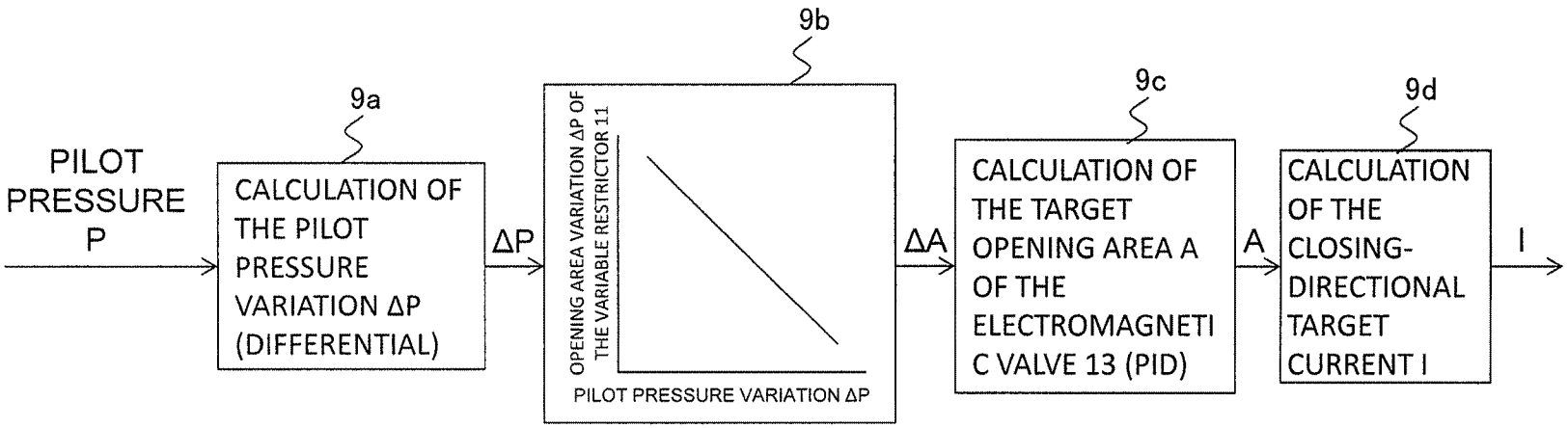
FIG. 3 shows functional blocks of opening area control for a second variable restrictor by a controller according to the first embodiment of the hydraulic drive system for the construction machine of the present invention.

As shown in FIG. 3, the controller 19 differentiates the pressure of the hydraulic fluid of the pilot line 6*d* detected by the pressure sensor 16 to calculate a pilot pressure variation (time variation) ΔP (Block 9*a*). The pilot pressure variation ΔP corresponds to the operation speed of the control lever 6*a* of the control lever device 6. The controller 19 next calculates the opening area variation ΔA of the variable restrictor 12 (Block 9*b*). The opening area variation ΔA corresponds to the operation speed of the variable restrictor 12 in the closing direction thereof. The variation A of the opening area is calculated by, as shown in FIG. 3, presetting the relationship between ΔP and ΔA in which as the pilot pressure variation ΔP is increased (the operation speed of the control lever 6*a* of the control lever device 6 is increased), the opening area variation ΔA is reduced (the operation speed of the variable restrictor 12 in the closing direction thereof is reduced). Then, the opening area variation ΔA is obtained by relating the pilot pressure variation ΔP calculated in Block 9*a* to such a relationship. The controller 19 next calculates the target opening area A of the variable restrictor 12 from the opening area variation ΔA (Block 9*c*). This calculation is carried out by e.g. PID (proportion-integration-differentiate) operation. Thereafter, the controller 19 converts the target opening area A to the target current value I of the electromagnetic valve 13 and outputs an associated control current to the electromagnetic valve 13 (Block 9*d*). The electromagnetic valve 13 is operated in response to the target current value I outputted from the controller 19 to produce pilot pressure corresponding to the target current value I using the discharge pressure of the pilot pump 3 led via a line 25 as an original pressure and outputs it to a pilot line 26. The pilot pressure outputted to the pilot line 26 is led to the operation port of the variable restrictor 12 to regulate the opening area of the variable restrictor 12 in response to such pilot pressure.

Figure 4A:
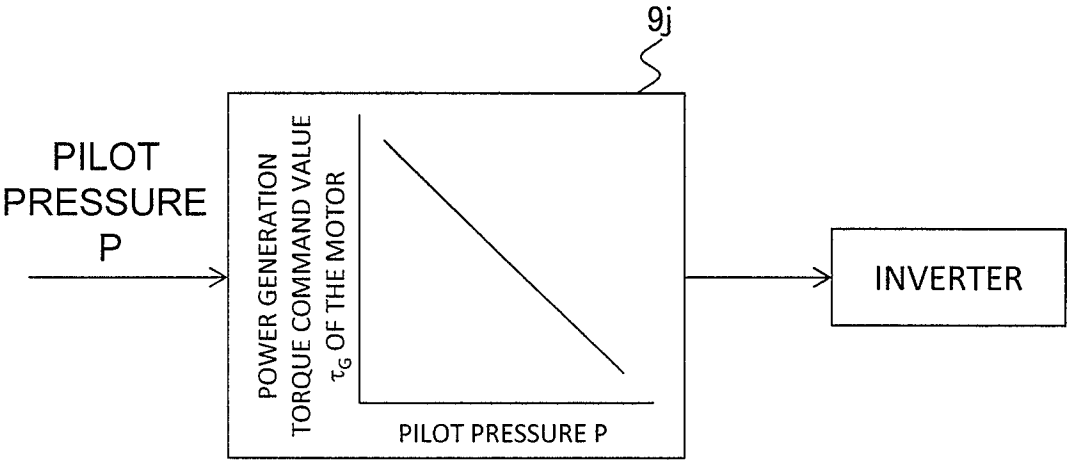
FIG. 4A shows a functional block of control for a hydraulic pump/motor by the controller according to the first embodiment of the hydraulic drive system for the construction machine of the present invention.

The controller 19 controls the generator/electric motor 10 as a generator. FIG. 4A shows control-content (calculation) processing performed by the controller 19 at this time. The controller 19 has the preset relationship between P and $\tau_g$ in which as the pilot pressure P is increased, power generation torque $\tau_g$ of the generator/electric motor 10 is reduced so that the lowering speed of the boom cylinder 5 may become cylinder speed according to the lowering operation amount of the control lever 6*a* of the control lever device 6. The controller 19 calculates associated $\tau_g$ by relating the pilot pressure P detected by the pressure sensor 16 to such a relationship (Block 9*j*). The controller 19 controls the power generation torque of the generator/electric motor 10 via the inverter 18*a* on the basis of a command value $\tau_g$ of the power generation torque. In this way, the hydraulic pump/motor 7 is given resistance torque corresponding to the power generation torque of the generator/electric motor 10. The hydraulic pump/motor 7 is rotated at rotation speed corresponding to the power generation torque of the generator/electric motor 10 to control the delivery rate thereof.

The controller 19 controls the opening area of the variable restrictor 11 to control the flow rate (the recovery flow rate) of the hydraulic fluid supplied from the bottom-side chamber 5*b* to rod-side chamber 5*a* of the boom cylinder 5 via the hydraulic pump/motor 7 and via the recovery circuit 23 becomes a flow rate according to the lowering speed of the boom cylinder 5 corresponding to the operation amount of the control lever 6*a* of the control lever device 6 and the rod-side chamber 5*a* is prevented from having negative pressure. FIG. 5 shows control-content (calculation) processing performed by the controller 19 in this case.

Figure 5:
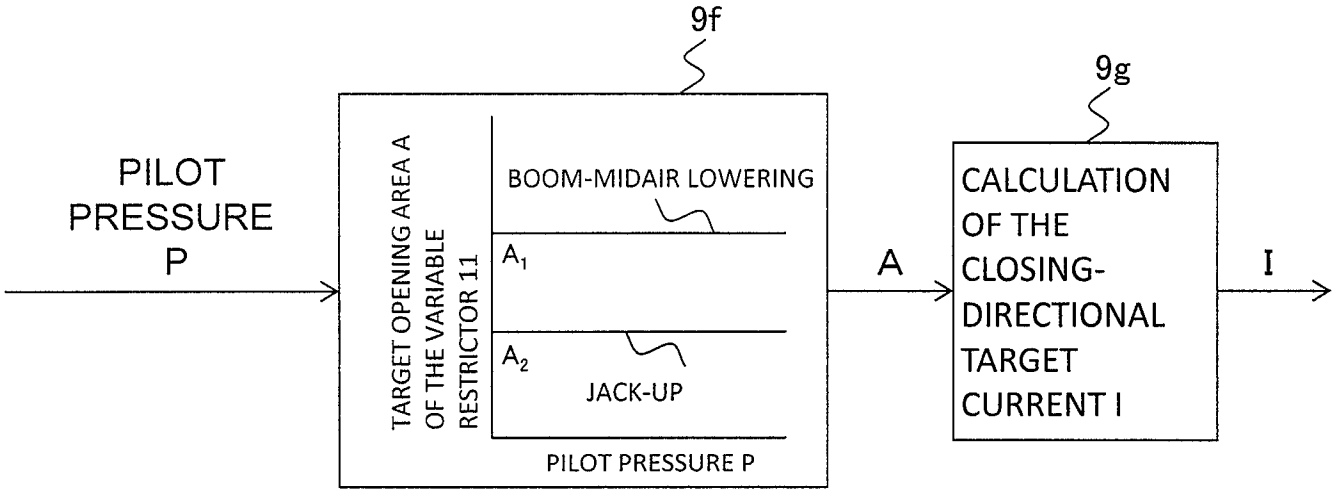
FIG. 5 shows functional blocks of opening area control for a first variable restrictor by a controller according to the first embodiment of the hydraulic drive system for the construction machine of the present invention.

As shown in FIG. 5, the controller 19 has a preset target opening area $A_1$ appropriate for boom-midair lowering operation and a preset target opening area $A_2$ appropriate for jack-up operation. The controller 19 selects the target opening area $A_1$ of the midair lowering operation as a target opening area A (Block 9*f*). The controller 19 next converts the target opening area A ($A_1$) thus selected to the target current value I of the electromagnetic valve 14 and outputs an associate control current to the electromagnetic valve 14 (Block 9*g*). The electromagnetic valve 14 is operated in response to the target current value I outputted from the controller 19 to produce pilot pressure corresponding to the target current value I using the discharge pressure of the pilot pump 3 led via the line 25 and a line 27 as an original pressure and outputs it to a pilot line 28. The pilot pressure outputted to the pilot line 28 is led to the operation port of the variable restrictor 11. The variable restrictor 11 is adjusted in response to the pilot pressure so that the opening area thereof becomes $A_1$.

The control is exercised as described above. The hydraulic fluid is discharged from the bottom-side chamber 5*b* of the boom cylinder 5. The hydraulic fluid thus discharged flows in the discharge line 22 via the holding valve 9 to rotate the hydraulic pump/motor 7 for power generation operation of the generator/electric motor 10. The electric power thus generated is stored in the battery 18*c*. Thus, the positional energy of the boom 131 is recovered as electric energy. The hydraulic fluid that has rotated the hydraulic pump/motor 7 partially flows into the rod-side chamber 5*a* of the boom cylinder 5 via the check valve 8 of the recovery circuit 23. The remaining of the hydraulic fluid returns to the hydraulic operating fluid tank T via the variable restrictor 11.

As described above, the hydraulic fluid discharged from the bottom-side chamber 5*b* of the boom cylinder 5 is partially supplied to the rod-side chamber 5*a* side of the boom cylinder 5 as a recovery flow rate. Therefore, the hydraulic fluid is not supplied from the main pump 2 to the rod-side chamber 5*a* of the boom cylinder 5. Thus, the drive energy of the main pump 2 can be saved.

—Jack-Up—

A description is next given of operation in the case where the track structure 110 is partially lifted from the ground by operatively lowering the boom 131 to allow the front work implement 130 contacting with the ground to push the ground (jack-up).

An operator continuously operates the control lever 6*a* of the control lever device 6 in the boom-lowering direction B. When the bucket 135 of the front work implement 130 comes into contact with the ground, a pressing force acts on the front work implement 130. In this case, a pull force acts on the boom cylinder 5; therefore, the pressure of the hydraulic fluid in the bottom-side chamber 5*b* of the boom cylinder 5 is lowered.

The pilot pressure detected by the pressure sensor 16 may be higher than the minimum pressure of the pilot pressure. In addition, the pressure of the hydraulic fluid on the bottom-side chamber 5*b* side of the boom cylinder 5 detected by the pressure sensor 15 may be equal to or lower than a predetermined pressure. In such a case, the controller 19 determines that the front work implement 130 cannot be turned in the lowering direction under the self-weight of the boom 131, that is, that jack-up operation is instructed. In addition, the controller 19 exercises the control as below.

The controller 19 performs the same processing as during the boom-midair lowering operation, and thereby outputs a target current value I to the electromagnetic valve 13 so as to reduce the opening area of the variable restrictor 12.

Figure 4B:
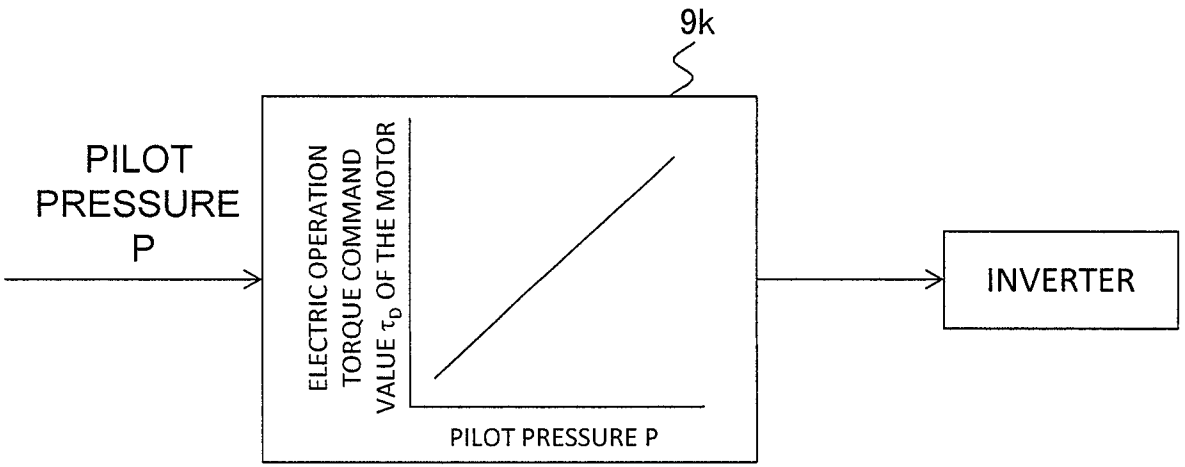
FIG. 4B shows a functional block of control for the hydraulic pump/motor by the controller according to the first embodiment of the hydraulic drive system for the construction machine of the present invention.

As shown in FIG. 4B, the controller 19 controls the generator/electric motor 10 as an electric motor. FIG. 4B shows control-content (calculation) processing performed by the controller 19 at this time. The controller 19 presets the relationship between P and $\tau_d$ in which as the pilot pressure P is increased, the electric operation torque $\tau_d$ of the generator/electric motor 10 is increased so that the lowering speed of the boom cylinder 5 may become cylinder speed according to the lowering operation amount of the control lever 6*a* of the control lever device 6. The controller 19 calculates associated $\tau_d$ by relating the pilot pressure P detected by the pressure sensor 16 to such a relationship (Block 9*k*). In addition, the controller 19 controls the electric operation torque of the generator/electric motor 10 via the inverter 18*a* on the basis of the command value $\tau_d$ of the electric operation torque. In this way, the hydraulic pump/motor 7 is given resistance torque corresponding to the electric operation torque of the generator/electric motor 10. The hydraulic pump/motor 7 is rotated at rotation speed corresponding to the electric operation torque of the generator/electric motor 10 to control the delivery rate thereof.

The controller 19 controls the opening area of the variable restrictor 11 as below. Hydraulic fluid is supplied from the bottom-side chamber 5*b* to rod-side chamber 5*a* of the boom cylinder 5 via the hydraulic pump/motor 7 and the recovery circuit 23. The flow rate (the recovery flow rate) of such hydraulic fluid is made equal to a flow rate necessary to allow the pressing force needed to lift a portion of the track structure 110 from the ground to act on the front work implement 130 via the boom cylinder 5. FIG. 5 shows control-content (calculation) processing performed by the controller 19 in this case.

As described above, the controller 19 has the preset target opening area $A_1$ appropriate for boom-midair lowering operation and the preset target opening area $A_2$ appropriate for jack-up operation. The controller 19 selects the target opening area $A_2$ for the jack-up operation as a target opening area A (Block 9*f*). The controller 19 next converts the target opening area A ($A_2$) thus selected to the target current value I of the electromagnetic valve 14 and outputs an associate control current to the electromagnetic valve 14 (Block 9*g*). The electromagnetic valve 14 is operated in response to the target current value I outputted from the controller 19 to produce pilot pressure corresponding to the target current value I using the discharge pressure of the pilot pump 3 led via the lines 25, 27 as an original pressure and outputs it to a pilot line 28. The pilot pressure outputted to the pilot line 28 is led to the operation port of the variable restrictor 11. The variable restrictor 11 is adjusted in response to the pilot pressure so that its opening area becomes $A_2$.

The control is exercised as described above. Because of the electric operation of the generator/electric motor 10, the hydraulic pump/motor 7 is operated as a pump. The hydraulic fluid is sucked from the bottom-side chamber 5*b* of the boom cylinder 5 and is partially supplied to the rod-side chamber 5*a* of the boom cylinder 5 via the check valve 8 of the recovery circuit 23. In this way, the boom cylinder 5 is contracted, so that the pressing force necessary to lift a portion of the track structure 110 from the ground acts on the front work implement 130 via the boom cylinder 5 for the jack-up operation.

As described above, the hydraulic fluid discharged from the bottom-side chamber 5*b* of the boom cylinder 5 is partially supplied as a recovery flow rate toward the rod-side chamber 5*a* of the boom cylinder 5. Therefore, the hydraulic fluid is not supplied to the rod-side chamber 5*a* of the boom cylinder 5 from the main pump 2. Thus, the drive energy of the main pump 2 can be saved.

—Effects—

The hydraulic drive system for the construction machine of the first embodiment as described above is configured as follows: the generator/electric motor 10 which recovers the positional energy of the front work implement 130 is operated as an electric motor during the jack-up; and the hydraulic pump/motor as a recovery motor is rotated as a pump. The lines and the circuits are arranged so that when the control lever 6*a* is operated in the lowering direction B of the boom 131, the hydraulic fluid is supplied from the bottom-side chamber 5*b* to rod-side chamber 5*a* of the boom cylinder 5. During the boom-midair lowering operation in which the front work implement 130 can be turned under the self-weight of the boom 131, the hydraulic pump/motor 7 is operated as a motor and the generator/electric motor 10 is operated as a generator. The power generation operation is performed by the hydraulic fluid discharged from the bottom-side chamber 5*b* of the boom cylinder 5 to recover positional energy. Thus, an improvement in energy efficiency is achieved. The hydraulic fluid after the recovery is partially supplied to the rod-side chamber 5*a* of the boom cylinder 5 via the recovery circuit 23. Therefore, it is not necessary to supply the hydraulic fluid from the main pump 2 to the rod-side chamber 5*a* of the boom cylinder 5. During the jack-up operation in which the turning of the front work implement 130 under the self-weight of the boom 131 is impossible, the generator/electric motor 10 is operated as an electric motor to operate the hydraulic pump/motor 7 as a pump. Because of the pumping operation of the hydraulic pump/motor 7, the hydraulic fluid is supplied from the bottom-side chamber 5*b* to rod-side chamber 5*a* of the boom cylinder 5. In this way, the jack-up operation is performed without supplying the hydraulic fluid from the main pump 2 to the rod-side chamber 5*a* of the boom cylinder 5.

Consequently, unlike the hydraulic drive system described in Patent Document 1, it is not necessary during the jack-up operation to install the first and second holding valves and control the opening and closing thereof. In addition, the circuit configuration of the hydraulic drive system is not complicated; therefore, no difficulty would arise in terms of installation space and costs. During the jack-up operation, it is not necessary to supply hydraulic fluid from the main pump 2 to the rod-side chamber 5*a* of the boom cylinder 5; therefore, energy efficiency can be improved.

Unlike the hydraulic drive system described in Patent Document 2, it is not necessary to install the jack-up switching valve and the flow control valve in order to perform both the midair lowering operation of the boom 131 and the jack-up operation. The hydraulic drive system of the present embodiment has advantages as below. The circuit configuration of the hydraulic drive system is not complicated; therefore, no difficulty would arise in terms of installation space and costs. During the jack-up operation, it is not necessary to supply hydraulic fluid from the main pump 2 to the rod-side chamber 5*a* of the boom cylinder 5; therefore, energy efficiency can be improved.

The pressure sensor 15 to detect the pressure in the bottom-side chamber 5*b* is provided in the first line 20. The control lever 6*a* of the control lever device 6 may be operated in the lowering direction of the front work implement 130. In addition, the pressure detected by the pressure sensor 15 may be equal to or higher than the predetermined pressure. In such a case, the controller 19 determines that the boom cylinder 5 is in the state of being lowered under the self-weight of the boom 131 of the front work implement 130. Otherwise, the controller 19 determines that the boom cylinder 5 is not in the state of being lowered under the self-weight of the boom 131 of the front work implement 130. In this way, the determination as to whether or not the turning of the front work implement 130 under the self-weight of the boom 131 is possible can be achieved with a simple configuration.

Further, when the control lever 6*a* of the control lever device 6 is operated in the rising direction A of the front work implement 130, the controller brings the variable restrictor 12 into the opening state. When the control lever 6*a* of the control lever device 6 is operated in the lowering direction B of the front work implement 130, the controller 19 controls the variable restrictor 12 in the closing direction. In addition, the controller 19 controls the operation speed in the closing direction at that time so as to be reduced as the operation speed of the control lever 6*a* of the control lever device 6 is increased. The response speed of the boom cylinder 5 can be increased in response to the operation of the control lever 6*a* encountered when the front work implement 130 is operated in the rising direction and in the lowering direction. Thus, an improvement in operability can be achieved. In particular, the hydraulic pump/motor 7 starts to move slowly because of inertia; therefore, hydraulic fluid cannot quickly flow in the discharge line 22 at the time of the lowering operation of the front work implement 130. However, the variable restrictor 12 is controlled in the closing direction and the operation speed in the closing direction at that time is controlled so as to be reduced as the operation speed of the control lever 6*a* of the control lever device 6 is increased. Therefore, the hydraulic fluid is discharged from the bottom-side chamber 5*b* of the boom cylinder 5 via the first line. Thus, responsiveness can be improved.

The delivery rate of the hydraulic pump/motor 7 is controlled by controlling the rotation speed of the generator/electric motor 10. With this configuration for recovering the positional energy of the front work implement 130, the operation speed of the boom cylinder 5 in the lowering direction according to the operation amount and operation speed of the control lever 6*a* can be achieved.

Second Embodiment

A second embodiment of the hydraulic drive system for the construction machine of the present invention is next be described with reference to FIG. 6.

Figure 6:
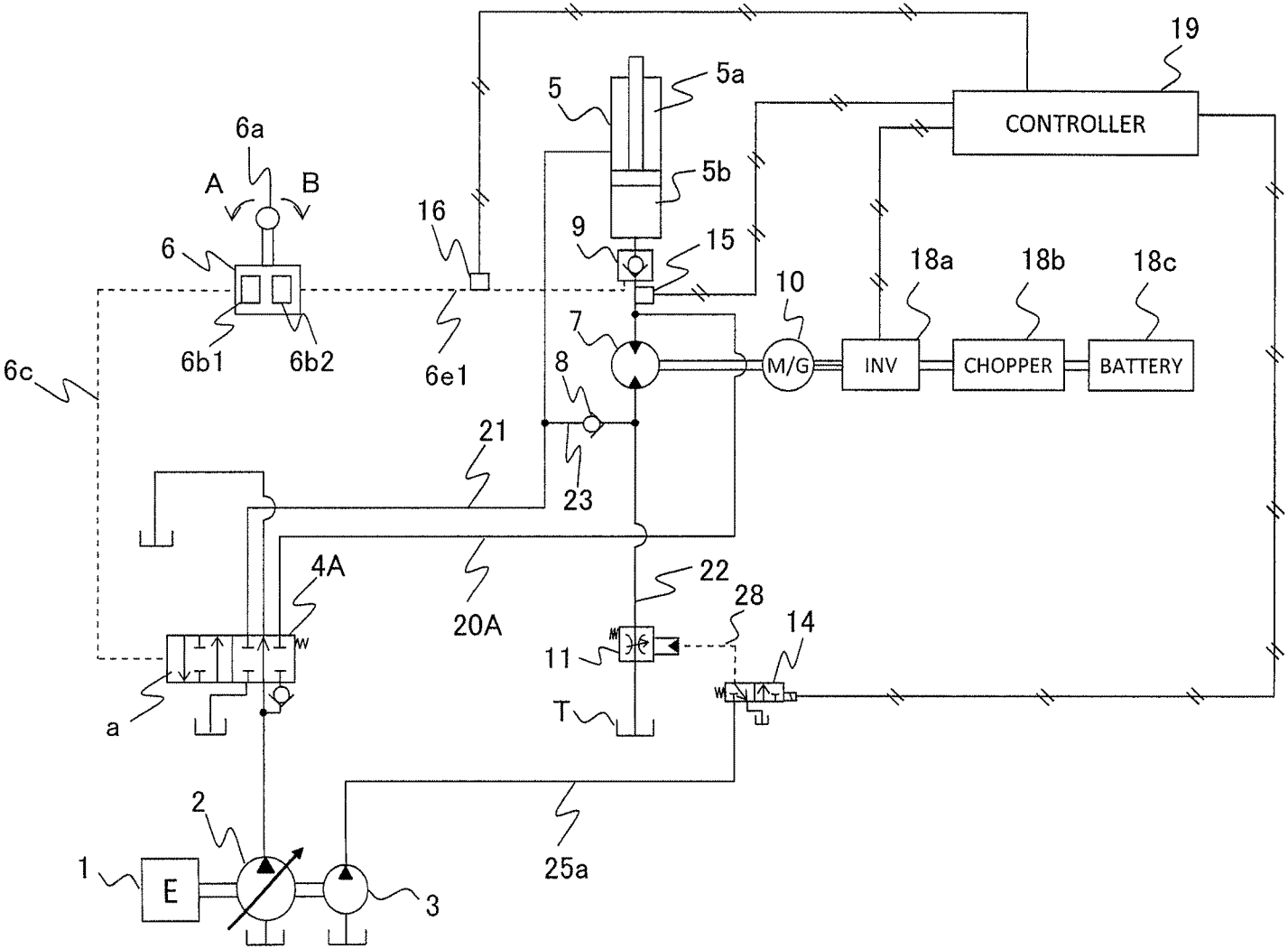
FIG. 6 is a configuration diagram showing an outline of a second embodiment of a hydraulic drive system for a construction machine of the present invention.

FIG. 6 shows the second embodiment of the hydraulic drive system for the construction machine of the present invention. The hydraulic drive system for the construction machine of the second embodiment has a first line 20A not provided with the variable restrictor in place of the first line 20 provided with the variable restrictor 12 incorporated in the hydraulic drive system for the construction machine of the first embodiment.

Additionally, the hydraulic drive system for the construction machine of the second embodiment has a directional control valve 4A. When the directional control valve 4A assumes a neutral position and the boom 131 is operated in the rising direction, the configuration of the directional control valve 4A is almost the same as that of the directional control valve 4 of the hydraulic drive system for the construction machine of the first embodiment. When the control lever device 6 is operated in the lowering direction of the boom 131, the directional control valve 4A assumes the neutral position to block the first and second lines and returns the hydraulic fluid discharged from the main pump 2 to the tank T. Further, the hydraulic drive system for the construction machine of the second embodiment has, in place of the pilot line 6*e*, a pilot line 6*e*1 to transfer pilot pressure to the holding valve 9.

Additionally, the hydraulic drive system for the construction machine of the second embodiment has, in place of the lines 25, 27, a line 25*a* to lead the discharge pressure of the pilot pump 3 to the variable valve 11 via the electromagnetic valve 14.

The other configurations are almost the same as those of the hydraulic drive system for the construction machine of the first embodiment described above.

—Operation—

A description is given of the operation of the hydraulic drive system for the construction machine of the second embodiment described above.

In the hydraulic excavator 100 as illustrated in FIG. 2, if an operator operates the control lever 6*a* of the control lever device 6 in the boom-raising direction A, the pilot valve 6*b*1 of the control lever device 6 outputs the pilot pressure corresponding to the operation amount of the control lever 6*a* to the pilot line 6*c* to switch the directional control valve 4 to the "a" position. In this case, the hydraulic fluid discharged from the main pump 2 passes through the first line 20A via the directional control valve 4A and flows into the bottom-side chamber 5*b* of the boom cylinder 5. As a result, the boom cylinder 5 is extended to turn the boom 131 in the rising direction. The hydraulic fluid discharged from the rod-side chamber 5*a* of the boom cylinder 5 returns to the hydraulic operating fluid tank T via the second line 21 and the directional control valve 4.

In a state where the front work implement 130 assumes such a posture as to be able to turn in the lowering direction under the self-weight of the boom 131, the operator may operate the control lever 6*a* of the control lever device 6 in the boom-lowering direction B. In such a case, the directional control valve 4A is first switched to the neutral position to block the first line 20A and the second line 21. Therefore, the hydraulic fluid discharged from the bottom-side chamber 5*b* of the boom cylinder 5 flows in the discharge line 22 in accordance with the starting of the hydraulic pump/motor 7. The other operations are almost the same as those of the boom-midair lowering operation in the hydraulic drive system for the construction machine of the first embodiment.

The jack-up operation is performed as below. In the state where the front work implement 130 is in contact with the ground, further the boom 131 is operatively lowered to allow the front work implement 130 to push the ground, whereby the track structure 110 is partially lifted from the ground. In such a case, the directional control valve 4A is switched to the neutral position to block the first line 20A and the second line 21. The hydraulic fluid discharged from the bottom-side chamber 5*b* of the boom cylinder 5 flows to the discharge line 22 in accordance with the starting of the hydraulic pump/motor 7. The other operations are almost the same as those of the jack-up operation in the hydraulic drive system for the construction machine of the first embodiment.

—Effects—

The hydraulic drive system for the construction machine of the second embodiment is inferior in operability to the hydraulic drive system for the construction machine of the first embodiment. However, the hydraulic drive system for the construction machine of the second embodiment produces almost the same effects as those of the hydraulic drive system for the construction machine of the first embodiment and has a merit in which the system configurations are more simplified.

Third Embodiment

—Configuration—

A third embodiment of the hydraulic drive system for the construction machine of the present invention is described with reference to FIGS. 7 and 8.

Figure 7:
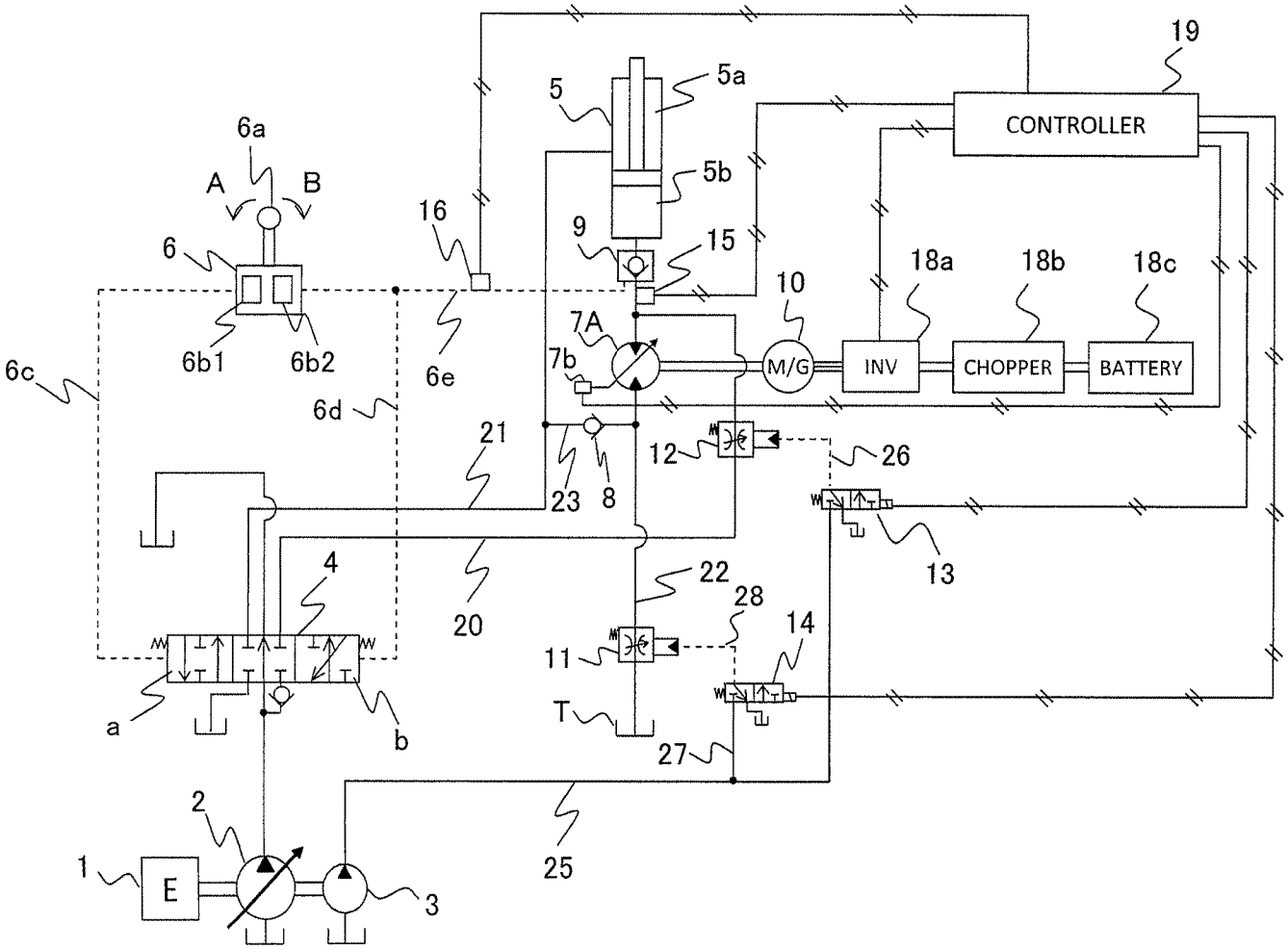
FIG. 7 is a configuration diagram showing an outline of a third embodiment of a hydraulic drive system for a construction machine of the present invention.

FIG. 7 shows the third embodiment of the hydraulic drive system for the construction machine of the present invention. The hydraulic drive system for the construction machine of the third embodiment has a variable displacement hydraulic pump/motor 7A in place of the fixed displacement hydraulic pump/motor 7 incorporated in the hydraulic drive system for the construction machine of the first embodiment. The hydraulic pump/motor 7A has a regulator 7*b*. The regulator 7*b* is operated in response to a control signal from the controller 19 to change the tilting angle of the hydraulic pump/motor 7A to bring the capacity thereof to a desired capacity. Thus, the delivery rate and torque of the hydraulic pump/motor 7A is made variable.

The other configurations are almost the same as those of the first embodiment of the hydraulic drive system for the construction machine described above.

—Operation—

The operation of the hydraulic drive system for the third embodiment described above is described with reference to FIG. 8.

In the hydraulic excavator as illustrated in FIG. 2, the operation encountered when an operator operates the control lever 6*a* of the control lever device 6 in the boom-raising direction A is almost the same as that of the hydraulic drive system for the construction machine of the first embodiment.

In the state where the front work implement 130 assumes such a posture as to be able to turn in the lowering direction under the self-weight of the boom 131, the operator may operate the control lever 6*a* of the control lever device 6 in the boom-lowering direction B. In such a case, the controller 19 performs the same processing as during the boom-midair lowering operation of the first embodiment, and thereby outputs a target current value I to the electromagnetic valve 13 so as to reduce the opening area of the variable restrictor 12.

Figure 8A:
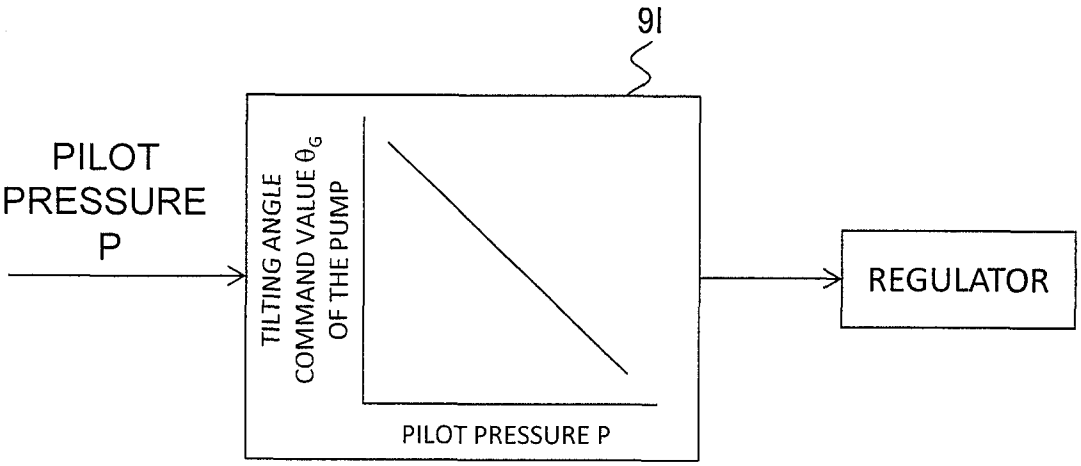
FIG. 8A shows a functional block of control of a hydraulic pump/motor by a controller according to the third embodiment of the hydraulic drive system for the construction machine of the present invention.

The controller 19 controls the generator/electric motor 10 as a generator. FIG. 8A shows control-content (calculation) processing performed by the controller 19 at this time. The controller 19 has the preset relationship between P and $\theta_g$ in which as the pilot pressure P is increased, the tilting angle $\theta_g$ of the hydraulic pump/motor 7A is reduced so that the lowering speed of the boom cylinder 5 may become cylinder speed according to the lowering operation amount of the control lever 6*a* of the control lever device 6. The controller 19 calculates the associated $\theta_g$ by relating the pilot pressure P detected by the pressure sensor 16 to such a relationship (Block 9*l*). The controller 19 controls the tilting angle of the swash plate of the hydraulic pump/motor 7 via the regulator 7*a* on the basis of the command value $\theta_g$ of the tilting angle. In this way, the hydraulic pump/motor 7 supplies the hydraulic fluid at a flow rate according to the tilting angle of the swash plate to control the delivery rate of the hydraulic pump/motor 7.

The controller 19 performs the same processing as during the boom-midair lowering operation of the first embodiment, and thereby outputs a target current value I to the electromagnetic valve 13 for controlling the opening area of the variable restrictor 12.

The jack-up operation is carried out as below. In the state where the front work implement 130 is in contact with the ground, further the boom 131 is operatively lowered to allow the front work implement 130 to push the ground, whereby the track structure 110 is partially lifted from the ground. In such a case, the controller 19 performs the same processing as during the jack-up operation of the first embodiment, and thereby outputs a target current value I to the electromagnetic valve 13 so as to reduce the opening area of the variable restrictor 12.

Figure 8B:
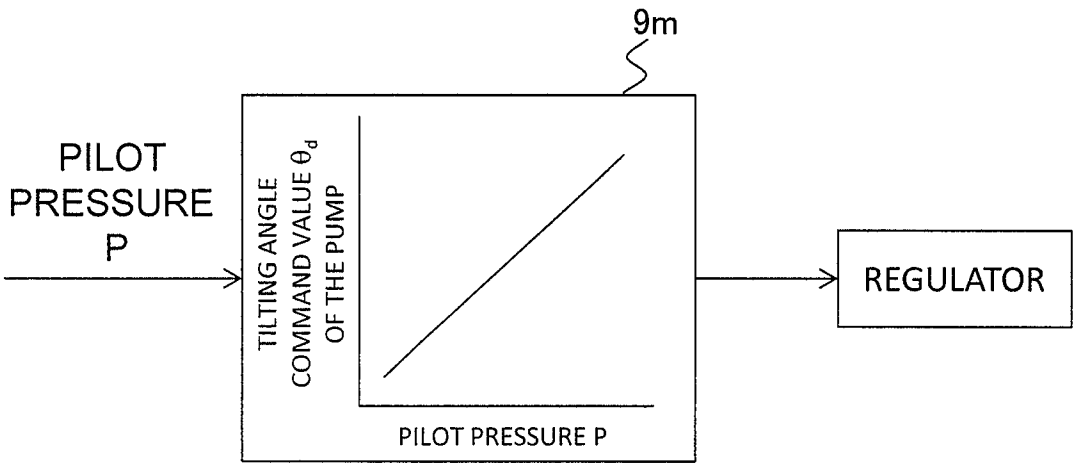
FIG. 8B shows a functional block of control for the hydraulic pump/motor by the controller according to the third embodiment of the hydraulic drive system for the construction machine of the present invention.

The controller 19 controls the generator/electric motor 10 as an electric motor. FIG. 8B shows control-content (calculation) processing performed by the controller 19 at this time. The controller 19 has the preset relationship between P and $\theta_d$ in which as the pilot pressure P is increased, the tilting angle $\theta_d$ of the hydraulic pump/motor 7A is increased so that the lowering speed of the boom cylinder 5 may become cylinder speed according to the lowering operation amount of the control lever 6*a* of the control lever device 6. The controller 19 calculates associated $\theta_d$ by relating the pilot pressure P detected by the pressure sensor 16 to such a relationship (Block 9*m*). The controller 19 controls the tilting angle of the swash plate of the hydraulic pump/motor 7 via the regulator 7*a* on the basis of the command value $\theta_d$ of the tilting angle. In this way, the hydraulic pump/motor 7 supplies the hydraulic fluid at a flow rate corresponding to the tilting angle of the swash plate to control the delivery rate of the hydraulic pump/motor 7.

Further, the controller 19 performs the same processing as during the boom-midair lowering operation of the first embodiment, and thereby outputs a target current value I to the electromagnetic valve 14 so as to control the opening area of the variable restrictor 11.

—Effects—

Also the hydraulic drive system for the construction machine of the third embodiment can produce also the same effects as those of the first embodiment of the hydraulic drive system for the construction machine described above.

The lowering speed of the boom cylinder 5 according to the operation amount of the control lever 6*a* can be achieved with a simple configuration by controlling the capacity of the hydraulic pump/motor 7 to control the delivery rate of the hydraulic pump/motor 7.

<Others>

Incidentally, the present invention is not limited to the embodiments described above but can be modified or applied in various ways.

EXPLANATION OF REFERENCE NUMERALS

1 . . . engine
2 . . . main pump
3 . . . pilot pump
4, 4A . . . directional control valve
5 . . . boom cylinder
5*a* . . . rod-side chamber
5*b* . . . bottom-side chamber
6 . . . control lever device (operating device)
6*a* . . . control lever
6*b*1, 6*b*2 . . . pilot valve
6*c*, 6*d*, 6*d*1, 6*e* . . . pilot line
7, 7A . . . hydraulic pump/motor
7*b* . . . regulator
8 . . . check valve

9 . . . holding valve
10 . . . generator/electric motor
11 . . . variable restrictor
12 . . . variable restrictor
13, 14 . . . electromagnetic valve
15 . . . pressure sensor (pressure detecting device)
16 . . . pressure sensor
18*a* . . . inverter
18*b* . . . chopper
18*c* . . . battery
19 . . . controller (control unit)
20, 20A . . . first line
21 . . . second line
22 . . . discharge line
23 . . . recovery circuit
25, 25*a*, 27 . . . line
26, 28 . . . pilot line
100 . . . hydraulic excavator
110 . . . track structure
111*a*, 111*b* . . . crawler
112*a*, 112*b* . . . crawler frame
113, 114 . . . right and left traveling hydraulic motors
120 . . . swing structure
130 . . . front work implement
131 . . . boom
133 . . . arm
134 . . . arm cylinder
135 . . . bucket
136 . . . bucket cylinder
T . . . tank

The invention claimed is:

1. A construction machine, comprising:

a front work implement including a boom;

a double-acting hydraulic cylinder including a rod-side chamber and a bottom-side chamber, the hydraulic cylinder being disposed to drive the front work implement and act in a contracting direction when the boom is subjected to its own weight;

a main pump to supply hydraulic fluid to the hydraulic cylinder;

an operating device to operate the front work implement;

a directional control valve disposed, when the operating device is operated for the boom to work in a rising direction, to supply hydraulic fluid discharged from the main pump to the bottom-side chamber of the hydraulic cylinder and to return the hydraulic fluid discharged from the rod-side chamber of the hydraulic cylinder to a tank;

a discharge line connecting the bottom-side chamber of the hydraulic cylinder to the tank;

a hydraulic pump/motor disposed in the discharge line;

a pressure sensor to detect a pressure in the bottom-side chamber of the hydraulic cylinder;

a first variable restrictor disposed in a portion of the discharge line between the hydraulic pump/motor and the tank;

a recovery circuit for connecting a portion of the discharge line between the hydraulic pump/motor and the variable restrictor to the rod-side chamber of the boom cylinder;

a generator/electric motor connected to the hydraulic pump/motor for integral rotation therewith; and a control unit configured to control the directional control valve to switch to a position where the hydraulic fluid discharged from the main pump connects to the tank, to control the generator/electric motor as a generator and to control an opening area of the first variable restrictor such that a recovery flow rate is supplied from the recovery circuit to the rod-side chamber of the hydraulic cylinder when the operating device is operated for the boom to work in a descending direction, the front work implement is in a posture to move in the descending direction under the own weight of the boom and the pressure detected by the pressure detecting device is greater than or equal to a predetermined pressure, wherein the control unit is further configured to control the directional control valve to switch to the position where the hydraulic fluid discharged from the main pump connects to the tank, to control the generator/electric motor as an electric motor and to control the opening area of the first variable restrictor such that the recovery flow rate is supplied from the recovery circuit to the rod-side chamber of the hydraulic cylinder when the operating device is operated for the boom to work in the descending direction, the front work implement presses a ground in a state where the front work implement is in contact with the ground and the pressure detected by the pressure detecting device is less than the predetermined pressure.

2. The construction machine according to claim 1, further comprising:

a first line for connecting the directional control valve to the bottom-side chamber of the hydraulic cylinder;

a second line for connecting the directional control valve to the rod-side chamber of the hydraulic cylinder; and a second variable restrictor disposed in the first line, wherein the directional control valve is configured such that:

when the operating device is operated for the boom to work in the rising direction, the main pump is connected to the first line and the second line is connected to the tank, and when the operating device is operated for the boom to work in the descending direction, the first line is connected to the tank and the second line is blocked, and wherein the control unit controls the second variable restrictor such that:

when the operating device is operated for the boom to work in the rising direction, the second variable restrictor is in an open state, and when the operating device is operated for the boom to work in the descending direction, the second variable restrictor switches into a closed state, and a switching speed in a closing direction of the second variable restrictor decreases as an operation speed of the operation device increases.

3. The construction machine according to claim 1, wherein, when the operating device is operated for the boom to work in the descending direction and the front work implement is in contact with the ground and presses the ground, the control unit is further configured to control a rotation speed of the generator/electric motor to control a delivery rate of the hydraulic pump/motor.

4. The a construction machine according to claim 1, wherein, when the operating device is operated for the boom to work in the descending direction and the front work implement is in contact with the ground and presses the ground, the control unit is further configured to control a capacity of the hydraulic pump/motor to control a delivery rate of the hydraulic pump/motor.

* * * * *